US007077359B2

(12) United States Patent
Poesch et al.

(10) Patent No.: US 7,077,359 B2
(45) Date of Patent: Jul. 18, 2006

(54) PNEUMATICALLY LAUNCHED FOLDING WING GLIDER TOY

(75) Inventors: Eric S. Poesch, Thousand Oaks, CA (US); Michael J. O'Connor, Thousand Oaks, CA (US); Joel A. Shrock, Berkeley, CA (US); Russell G. Rasmussen, Petaluma, CA (US)

(73) Assignee: Uncle Milton Industries, Westlake Village, CA (US)

( * ) Notice: Subject to any disclaimer, the term of this patent is extended or adjusted under 35 U.S.C. 154(b) by 0 days.

(21) Appl. No.: 10/776,812

(22) Filed: Feb. 11, 2004

(65) Prior Publication Data

US 2004/0248497 A1 Dec. 9, 2004

Related U.S. Application Data

(60) Provisional application No. 60/446,890, filed on Feb. 12, 2003.

(51) Int. Cl.
*B64F 1/04* (2006.01)

(52) U.S. Cl. ..... 244/63; 446/63; 124/63

(58) Field of Classification Search ..... 244/16, 244/63, 46; 446/63, 62, 61; 124/63
See application file for complete search history.

(56) References Cited

U.S. PATENT DOCUMENTS

| | | | | |
|---|---|---|---|---|
| 1,771,991 | A | | 8/1930 | Bissiri |
| 2,078,374 | A | | 4/1937 | Drobniewsky |
| 2,191,305 | A | | 2/1940 | Betts |
| 2,417,367 | A | | 3/1947 | Porter |
| 2,820,321 | A | | 1/1958 | Kuhn |
| 3,025,633 | A | | 3/1962 | Kaye et al. |
| 3,222,817 | A | | 12/1965 | Brandstetter |
| 3,369,319 | A | | 2/1968 | Brown |
| 3,380,189 | A | | 4/1968 | O'Millian |
| 3,408,767 | A | | 11/1968 | Anderson |
| 3,654,729 | A | | 4/1972 | Imperato |
| 3,739,764 | A | | 6/1973 | Allport |
| 3,839,818 | A | | 10/1974 | Heggedal |
| 4,223,472 | A | | 9/1980 | Fekete et al. |
| 4,411,249 | A | * | 10/1983 | Fogarty et al. ..... 124/64 |
| 4,759,736 | A | | 7/1988 | Carlson |
| 4,897,065 | A | * | 1/1990 | Fertig et al. ..... 446/63 |
| 4,915,664 | A | | 4/1990 | Bakker |
| 5,343,850 | A | * | 9/1994 | Steer ..... 124/64 |
| 5,381,778 | A | | 1/1995 | D'Andrade et al. |
| 5,415,153 | A | | 5/1995 | Johnson et al. |
| 5,701,879 | A | | 12/1997 | Johnson et al. |
| 6,321,737 | B1 | | 11/2001 | Johnson et al. |
| 6,347,623 | B1 | | 2/2002 | Kownacki et al. |

FOREIGN PATENT DOCUMENTS

| | | |
|---|---|---|
| GB | 2227950 A | 8/1990 |

* cited by examiner

*Primary Examiner*—Peter M. Poon
*Assistant Examiner*—Timothy D. Collins

(57) ABSTRACT

A glider toy has pivoting wings that may be locked in a retracted position prior to launch. Upon launching of the glider, the wings may be unlocked. During flight, the wings extend forward for an entertaining glide at the urging of one or more elastic members. A launcher includes an orientation-sensitive safety feature that limits the angles at which projectiles may be launched therefrom. The safety feature permits projectiles to be launched from the launcher only within approximately a generally upward, non-vertical angular range.

20 Claims, 10 Drawing Sheets

PNEUMATICALLY LAUNCHED FOLDING WING GLIDER TOY

This application claims priority benefit of the disclosure of U.S. provisional patent application 60/446,890 for Pneumatically Launched Folding Wing Glider Toy, filed Feb. 12, 2003.

BACKGROUND OF THE INVENTION

The present invention generally relates to toys, and more particularly to pneumatically projected glider aircraft toys.

Aerial toys such as airplane gliders have long been used for education and entertainment. Such gliders have conventionally been propelled into flight by way of a sling shot mechanism or by a user throwing the glider into flight. Such gliders have been limited in terms of altitude due to the traditional means used to launch the glider, as well as the drag forces acting against the wings of the glider during its ascent. For example, as to conventional gliders launched by a sling shot mechanism, the maximum altitude of the glider is limited in part by the strength of the rubber band or similar elastic member comprising the launching mechanism. As to gliders launched by a user throwing the glider, the maximum altitude of the glider is limited in part by the strength of the thrower.

Additionally, conventional glider launching mechanisms typically lack an orientation-sensitive safety feature. Consequently, such conventional gliders may be launched in virtually any direction. This presents a potential safety hazard in that a conventional glider may be launched directly at a person. Damage to the glider may also result from the glider being launched in an improper direction.

In contrast to conventional toy gliders, toy rockets are often propelled into flight by way of a pressurized fluid, such as air or water, or by way of a solid fuel. Such rockets have been able to reach altitudes that are much greater than altitudes attained by conventional gliders. However, rockets typically use a parachute to ease the rocket back to earth. While a parachute is effective in slowing a rocket's descent, it does not provide the visual stimulation provided by a glider. In addition, the substantially vertical flight path of a rocket is not as visually stimulating as the relatively more arcuate flight path of a glider.

Some existing launching mechanisms for pneumatically launched toy rockets include an orientation-sensitive safety feature that relieves pressure when the rocket is not oriented substantially vertically. In other words, where the launching mechanism has been pumped and enough pressure has been created to otherwise launch the rocket, the safety feature will allow the pressure to escape through a vent when the rocket is not oriented substantially vertically at the time the launching trigger is pressed. This produces the undesirable result of having to re-pump the launching mechanism for another launch attempt. In addition, conventional toy rocket safety features are configured to limit the operable launch angle to around 90 degrees; whereas the ideal launch angle for a glider may be less than 90 degrees.

Consequently, a significant need exists for a glider that is able to reach altitudes greater than those attained by conventional gliders, yet is able to glide back down to earth like a conventional glider. In addition, a need exists for a launcher that includes an orientation-sensitive safety feature, such that a glider may be launched therefrom only when the launcher is oriented within a particular angular range.

SUMMARY OF THE INVENTION

The invention overcomes the above-noted and other deficiencies of the prior art by providing a glider capable of reaching relatively great altitudes that is further capable of gliding back down to earth. In particular, a pivoting attachment of wings to a fuselage allows launch of a glider in a low-drag configuration. After a suitable interval upon reaching altitude, the wings extend forward, thus allowing the glider to glide in an entertaining fashion. A launcher may launch a projectile only when the hand-held launcher is oriented within a particular angular range.

In one aspect of the invention, a toy glider system is comprised of a glider and a launcher operable to launch the glider. The glider is comprised of pivoting wings and a proximally-open receptacle. The launcher is comprised of a support member configured to be received by the receptacle, a pneumatic pressure source, and a launch feature configured to selectively communicate a pressurized medium from the pressure source to impinge the pressurized medium against the glider.

In another aspect of the invention, a toy glider system is comprised of a glider and a launcher operable to launch the glider. The glider is comprised of pivoting wings and a wing sweep mechanism. The wing sweep mechanism has a locking mechanism operable to hold the wings in a locked position. The wing sweep mechanism is operable to urge the wings to an extended position when the locking mechanism is in an unlocked position. The locking mechanism is configured to change from the locked position to the unlocked position when the glider is launched from the launcher.

In yet another aspect of the invention, a launcher is operable to launch projectiles with a pressurized medium approximately within a generally upward, non-vertical angular range. The launcher is comprised of a launch guide, a trigger, a linkage, and a safety feature. The launch guide is configured to guide the angle at which projectiles are launched from the launcher. The linkage is configured to cause a projectile to be launched in response to communication of actuation of the trigger. The safety feature is responsive to the angle at which the launch guide is oriented. The safety feature is configured to enable communication of actuation of the trigger to the linkage in response to the launch guide being oriented approximately within a generally upward, non-vertical angular range.

In another aspect of the invention, a toy glider system is comprised of a glider and a launcher. The glider is comprised of wings and a means to pivot the wings. The launcher is comprised of a means to launch the glider and a means to limit an angular range within which the glider may be launched from the launcher.

In yet another aspect of the invention, a wing sweep mechanism in a glider provides for the wings of the glider to be retracted in an overlapping position, as one wing will rotate on a higher plane than the other. The wing sweep mechanism is further configured such that the wings will be parallel to the fuselage of the glider when the wings are in a retracted position; yet the wings will have a 5° angle of attack and a 5° dihedral angle when swept forward in the open position.

In another aspect of the invention, the wing sweep mechanism in a glider provides for a dampening effect allowing the wings to rotate forward upon sudden impact with the ground or other, objects preventing damage to the wing sweep mechanism and/or wings. The wings may be readjusted back into the proper operating orientation without damage to the wing sweep mechanism.

In yet another aspect of the invention, a pump pressure mechanism prevents over pressurization of a pressure chamber. The pump pressure mechanism has a relief valve feature configured to prevent further increase in pressure that may be created by the pump when the pressure in a pressure chamber reaches a threshold. The threshold is related to the strength of a spring in the relief valve feature.

In another aspect of the invention, a pressure mechanism in a launcher requires at least a minimum amount of pressure in order for a projectile to be launched from the launcher.

These and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention; it being understood, however, that this invention is not limited to the precise arrangements shown. In the drawings, like reference numerals refer to like elements in the several views. In the drawings.

DETAILED DESCRIPTION OF THE INVENTION

Figure 1:
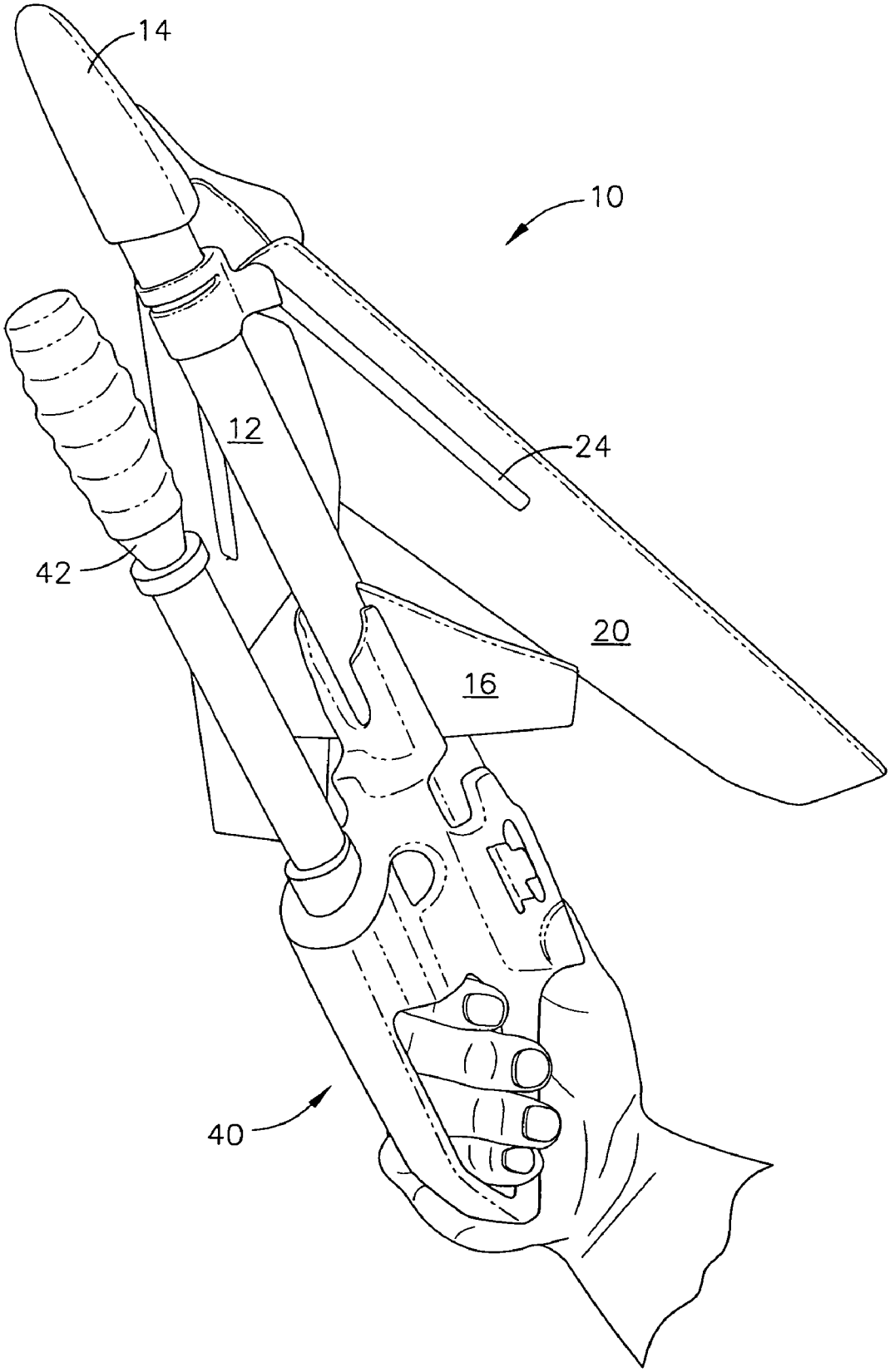
FIG. 1 depicts a perspective view of a glider engaged with a handheld launcher.

With reference to the drawings, FIG. 1 shows a handheld launcher 40 engaged with a glider 10. With reference to FIGS. 1 through 4, there is shown a glider 10 that has two pivoting, retractable wings 20 that deploy, or sweep outward and forward, sometime after launch. The glider 10 has a nose cone 14, a hollow fuselage 12, two wings 20 and four tail stabilizers 16. However, it will be appreciated that any suitable number of wings 20 or tail stabilizers 16 may be used. It will also be appreciated that the glider 10 need not have a cone-shaped nose. In addition, it will be appreciated that all or part of the fuselage 12 may be hollow. Still other configurations may be used.

Figure 3:
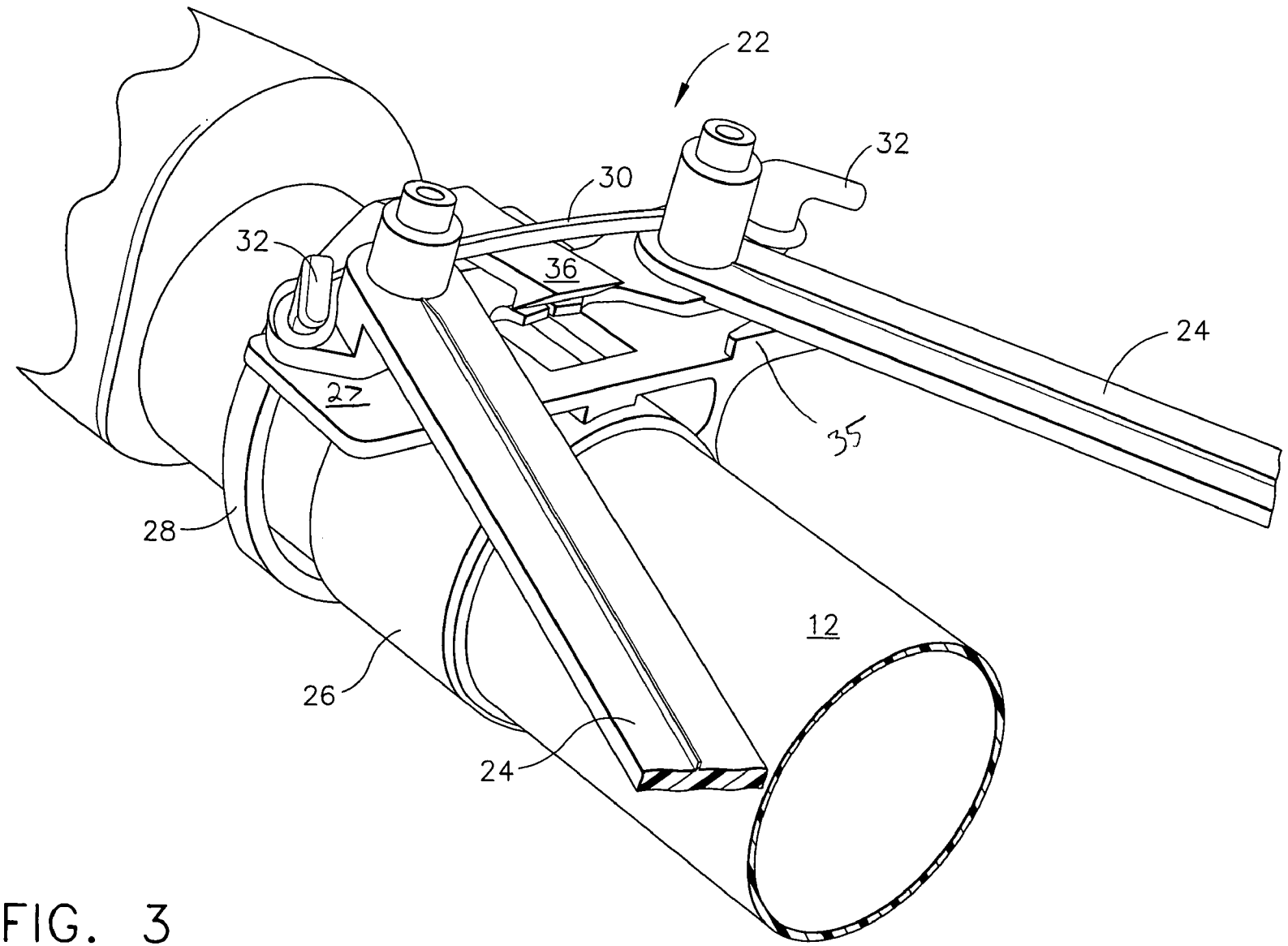
FIG. 3 depicts a perspective view of a wing sweep mechanism of the glider of FIG. 1 in a locked position.

The glider 10 in the present example has a wing sweep mechanism 22 that is configured to hold the wings 20 in a retracted position, partially above the fuselage 12, as shown in FIG. 3. However, it will also be appreciated that a wing sweep mechanism 22 may simply hold the wings 20 near, but not necessarily partially above, the fuselage 12. Preferably, the wing sweep mechanism 22 holds the wings 20 in a retracted position when the wing sweep mechanism 22 is in a locked position, and urges the wings 20 to an extended position when the wing sweep mechanism 22 is in an unlocked position.

In the present example, the wing sweep mechanism 22 is comprised of left and right wing pivot support members 24, a wing pivot mount body collar 26, a swinging annular member 28 and a rubber band 30. The wing sweep mechanism 22 is mounted in the forward section of the fuselage 12 of the glider 10. The pivot support members 24 are attached to the respective wings 20 and are also hingedly attached to the body collar 26, such that the wings 20 are able to rotate from a position where they are above or near the fuselage 12 to a position where they are fully extended. Each pivot support member 24 has a hook 32 located on the end of the pivot support member 24 that is nearest the fuselage 12. The hooks 32 of the pivot support members 24 are attached to the same rubber band 30. It will be appreciated that any suitable elastic alternative to a rubber band 30 may be used, such as, by way of example only, one or more springs. In the present example, the tension in the rubber band 30 urges the hooks 32 together, which rotates the wings 20 to a fully extended position. By way of example only, the rubber band 30 may provide just enough tension to overcome the drag force of flight and draw the wings 20 outward at approximately the apex of flight. Alternatively, a rubber band 30 may be selected that will overcome the drag force of flight and draw the wings 20 outward before or after reaching the apex of flight.

Figure 2:
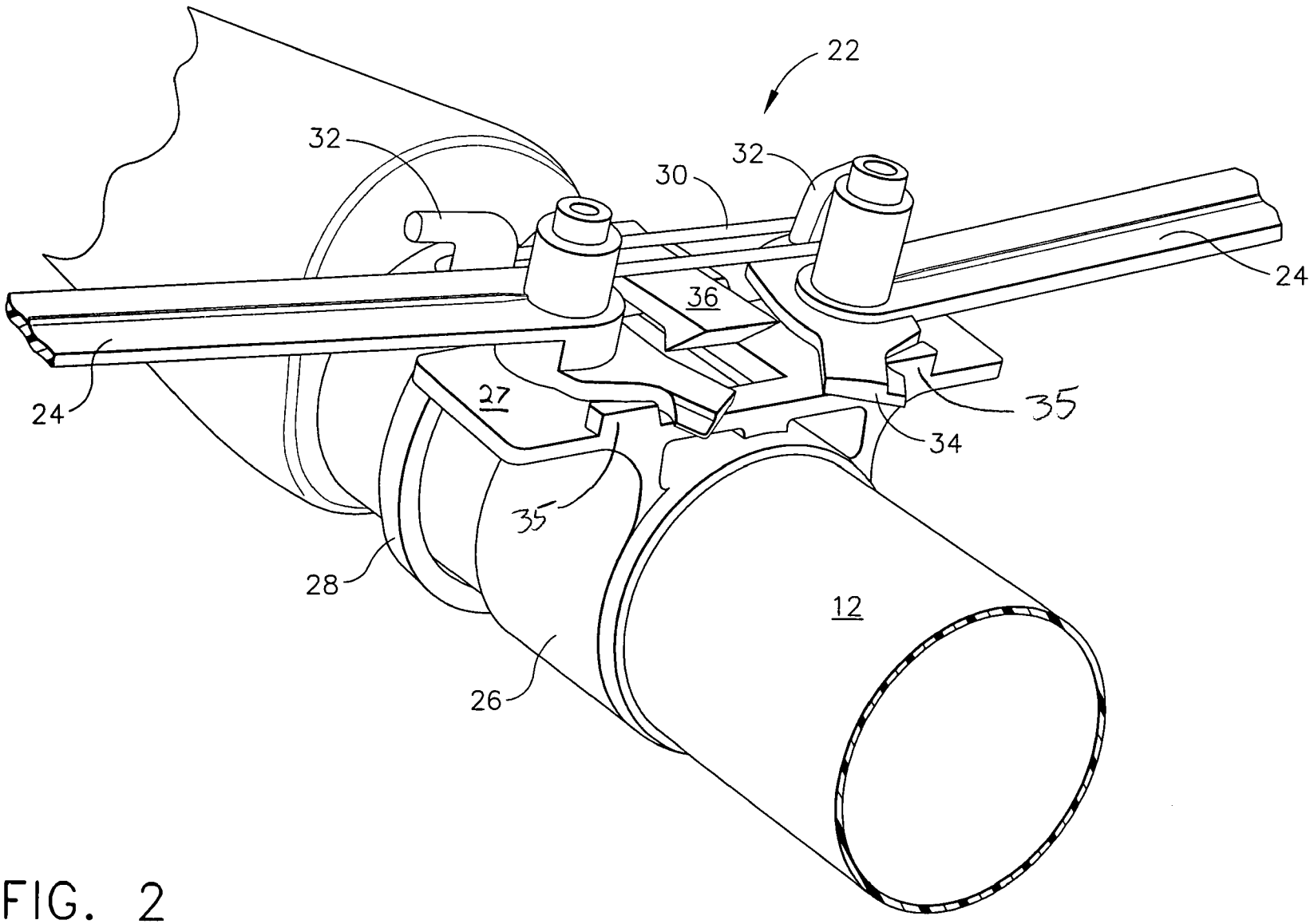
FIG. 2 depicts a perspective view of a wing sweep mechanism of the glider of FIG. 1 in an unlocked position.

The annular member 28 encircles the fuselage 12, and is hingedly attached to the body collar 26. The annular member 28 includes a clasp 36 protruding therefrom. The weight distribution of the annular member 28 encourages it to rotate forward relative to the fuselage 12, such that the clasp 36 is drawn away from the fuselage 12. In opposition to the force from this weight distribution, a spring 38 is placed between the annular member 28 and the fuselage 12, which urges the annular member 28 to rotate backward, such that the clasp 36 is drawn toward the fuselage. When the clasp 36 is drawn toward the fuselage 12, it may engage tabs 34 located at the end of each pivot support member 24 that is nearest the fuselage 12. Thus, a rearwardly-rotated annular member 28 may serve to hold the wings 20 locked in a retracted position, as shown in FIG. 3; whereas a forwardly-rotated annular member 28 presents an unlocked position, allowing the wings 20 to extend, as shown in FIG. 2. When the annular member 28 has been set to the locked position prior to the glider 10 being launched, a sudden change in velocity at launch may cause the annular member 28 to rotate to the unlocked position.

Figure 4:
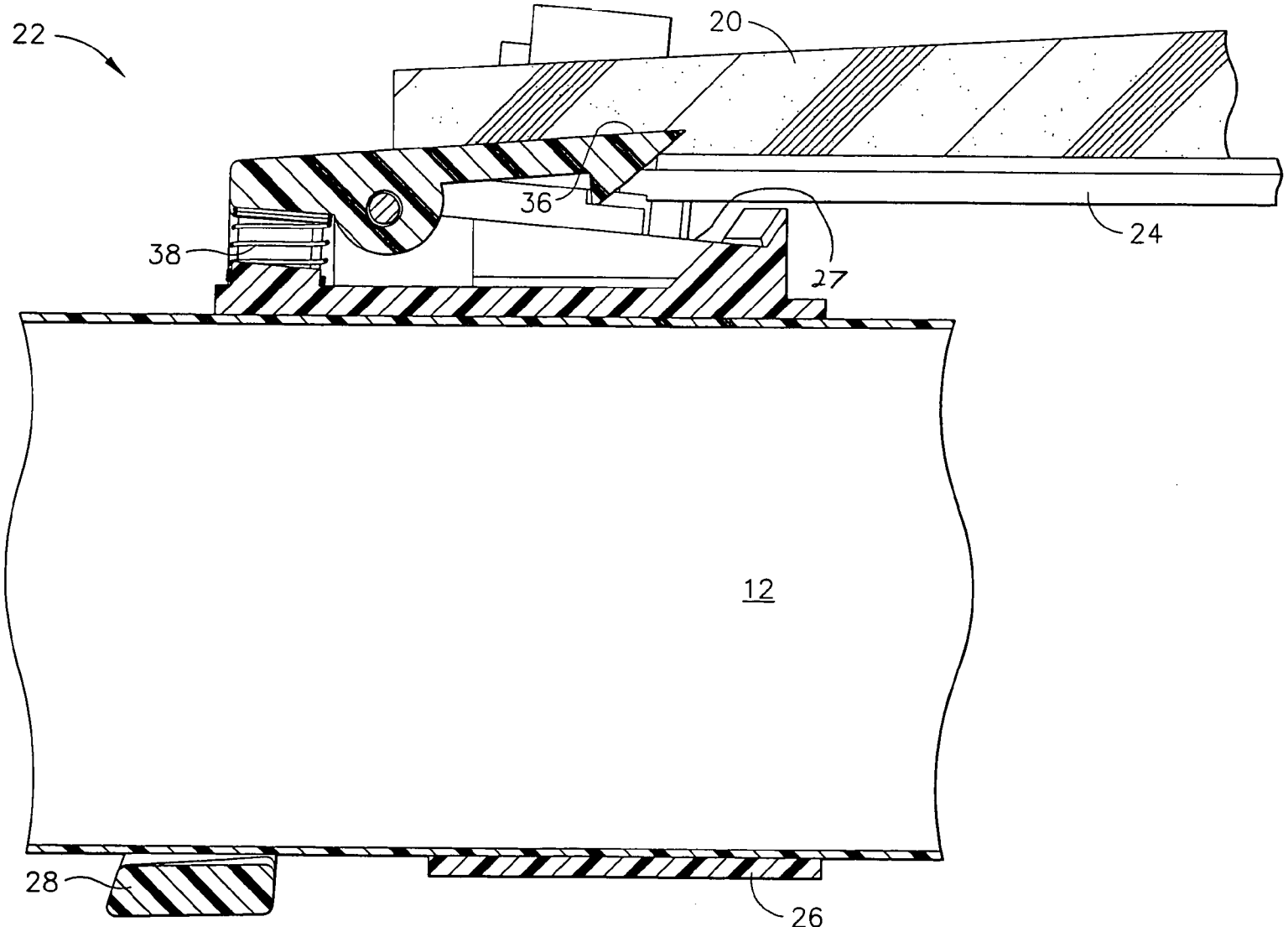
FIG. 4 depicts a cross section of a wing sweep mechanism of the glider of FIG. 1.
Figure 5:
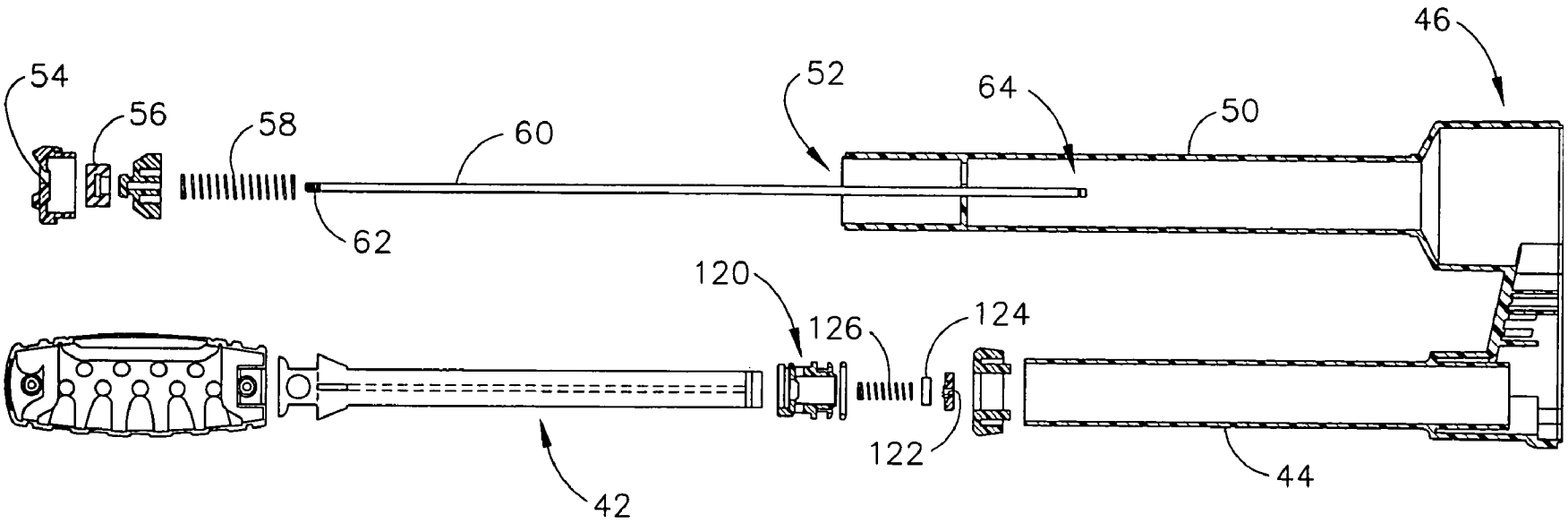
FIG. 5 depicts a partial exploded cross section of the launcher of FIG. 1.
Figure 6:
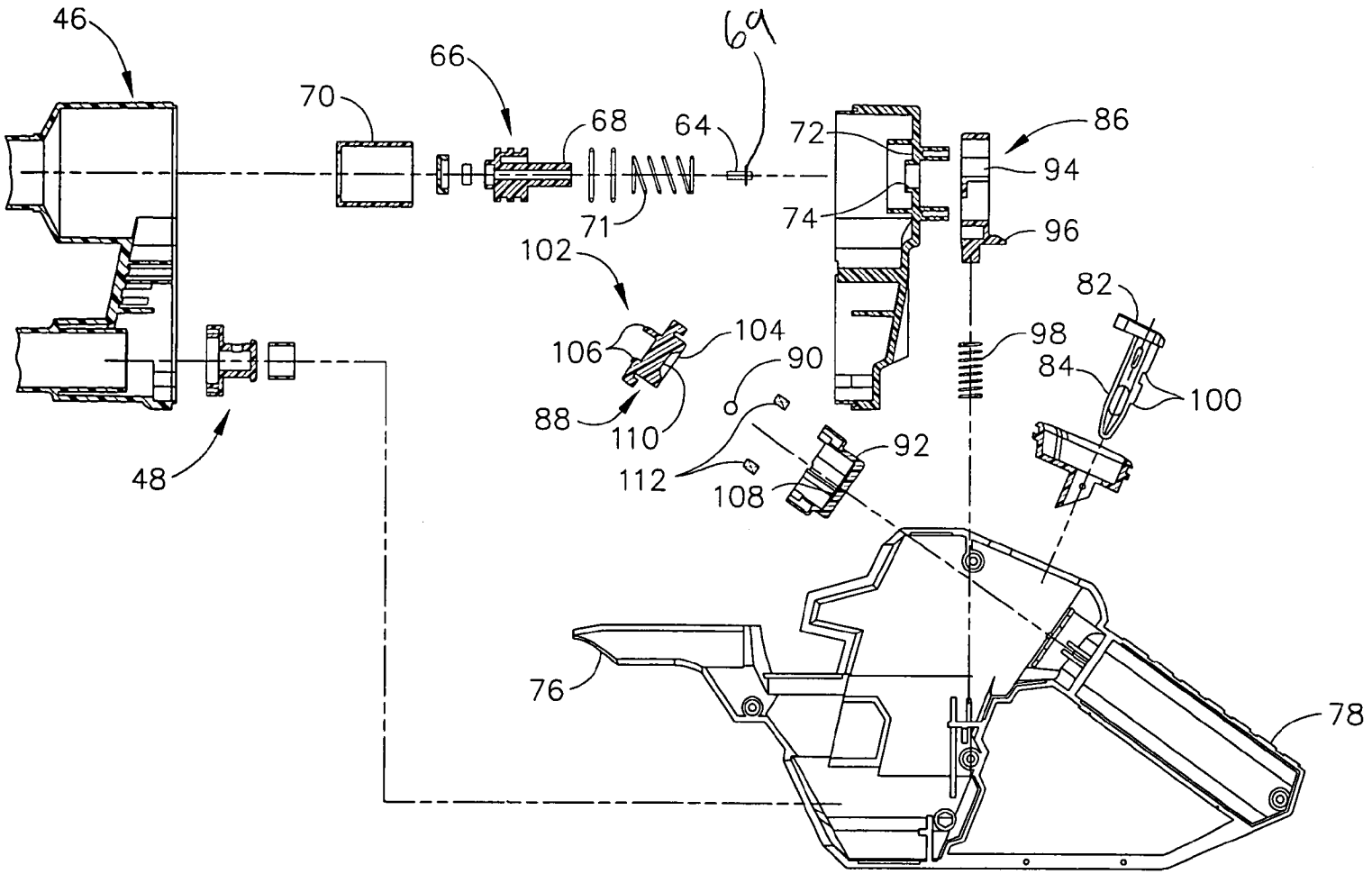
FIG. 6 depicts a partial exploded cross section of the launcher of FIG. 1.
Figure 7:
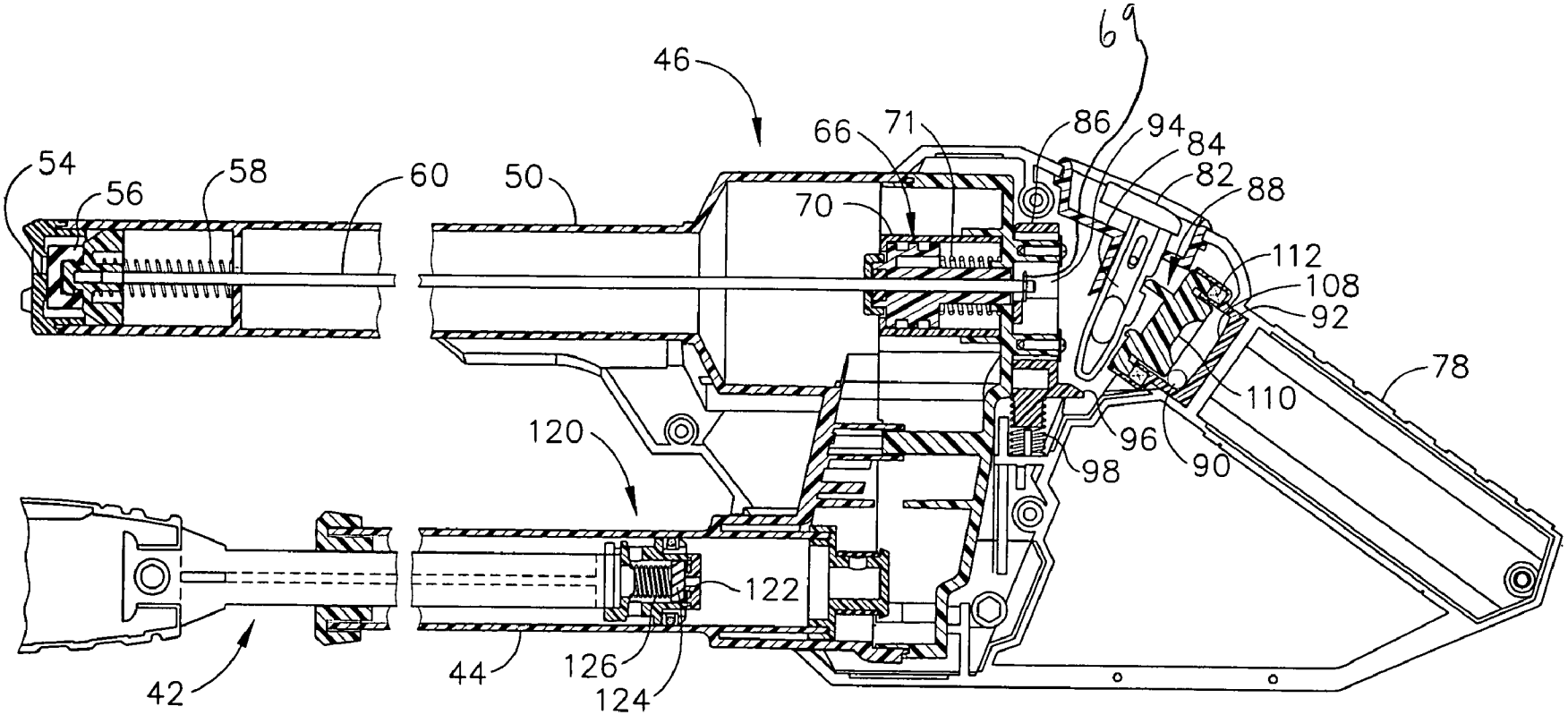
FIG. 7 depicts a cross section of the launcher of FIG. 1.

The body collar 26 has a top plate 27, upon which the pivot support members 24 are mounted. As shown in FIG. 4, the top plate 27 is tilted at a 5° angle toward the tail of the glider 10, providing an angle of attack. Alternatively, any other angle of attack may be provided by a different tilt of the top plate 27 or other means. In addition, the pivot support members 24 may be configured such that each wing is mounted at, for example, a 5° positive dihedral angle. Such a dihedral angle may provide wing stabilization and/or other benefits. Any other suitable dihedral angle or configuration may be used. Where a 5° angle of attack is created by tilting the top plate 27, and the pivot support members 24 are configured to provide a 5° dihedral angle for the wings 20, the wings 20 will be parallel to the fuselage 12 when the wings 20 are in a retracted position. Thus, in the present example, the wings 20 are relatively flat when in the retracted position, while the wings 20 are at a 5° angle of attack and a 5° dihedral angle when extended. Such a changing configuration may provide desirable aerodynamics for launching and subsequent descent.

The wing sweep mechanism 22 in the present example also provides for a dampening effect, allowing the wings 20 to rotate further forward upon sudden impact with the ground or other objects, thereby preventing damage to the wing sweep mechanism 22 and/or wings 20. As shown in FIGS. 2 and 3, a boss 35 protrudes from the top plate 27 of the body collar 26 for each pivot support member 24. Each boss 35 is configured such that, upon deployment of the wings 20, the boss will initially stop the sweeping of the wings 20 when the tabs 34 on the pivot support members 24 come into contact with each respective boss 35. The wings 20 will initially be kept from sweeping further forward by friction between each tab 34 and boss 35 in a positioning shown in FIG. 2. However, due to the configuration of each boss 35, this friction may be overcome upon impact of the glider 10 with the ground or another object, such that each pivot support member 24 may sweep forward past the proper operating orientation, as the tabs 34 are permitted to move over the top of the respective boss 35 when the friction is overcome. This provides a dampening effect of shock absorption, which may reduce the likelihood of the wing sweep mechanism 22 or its components from fracturing upon impact. The wings 20 may be readjusted back into the proper operating orientation without damage to the wing sweep mechanism 22.

In the present example, the wings 20 partially overlap when in the retracted position. This is accomplished, in part, by configuring the pivot support member 24 for each wing 20 slightly differently, such that one wing rotates on a higher plane than the other wing. As shown in FIGS. 2 and 3, the configuration of the pivot support members 24 is such that the left wing 20 mounted to the left pivot support member 24 will be vertically higher than the right wing 20 mounted to the right pivot support member 24. It will be appreciated by those of ordinary skill in the art that having one wing 20 slightly vertically higher than another may not significantly affect the flight of the glider 10. It will also be appreciated that other configurations may be used to permit overlap of the wings 20. Alternatively, the glider 10 may be configured such that the wings 20 do not overlap at all.

With reference to FIGS. 1 and 5 through 10, there is shown a launcher 40 comprised of a manual air pump 42 in a pump housing 44 in fluid communication with a pressure chamber 46. A check valve 48 prevents air from escaping from the pressure chamber 44 into the pump housing 44. The pressure chamber 46 is comprised of the inside of a launch tube 50. A distal end 52 of the launch tube 50 has a hole 54 through which air may exit and provide thrust to the glider 10. A valve 56 covers the hole 54, and is held in place by a spring 58, which aids in preventing pressurized air from escaping through the hole 54 until the valve 56 is proximally retracted. When the valve 56 is so closed, the pressure chamber 46 is sufficiently sealed to allow air to pressurize in the pressure chamber 46 when the pump 42 is reciprocated. The valve 56 is in mechanical communication with the distal end 62 of a rod 60, which, in the present example, causes retraction of the valve 56 when the rod 60 is moved proximally. Alternatively, an additional lever or linkage may be added such that the valve 56 is proximally retracted when the rod 60 is moved distally.

In the present example, the hole 54 acts as a launch feature configured to transmit pressurized air to the glider 10. However, it will be appreciated that an alternative pressurized medium may be used, such as, by way of example only, water. It will also be appreciated that an alternative launch feature may be used to transmit a pressurized medium to the glider 10, such as, by way of example only, a hose.

The proximal end 64 of the rod 60 is comprised of a piston member 66. This piston member 66 is slidably disposed within a piston cylinder 70 at the proximal wall 72 of the pressure chamber 46. At the proximal end of the piston cylinder 70, there is a hole 74 formed through the proximal wall 72. The proximal end of the piston member 66 has a protuberance 68 that is configured to fit, in part, through the hole 74. In the present example, the rod 60 comprises the axis of the piston member 66, and the piston member 66 is slidably engaged with the rod 60. The proximal end 62 of the rod 60 has an "e"-clip 69 configured, in part, to keep the piston member 66 from sliding off of the proximal end 62 of the rod 60 when the launcher 40 is fired. It will be appreciated by those of ordinary skill in the art that other configurations may be used.

A seal exists between the piston member 66 and wall of the piston cylinder 70, such that pressure may not escape from the pressure chamber 46 through the proximal hole 74. Nevertheless, a buildup of pressure within the pressure chamber 46 will urge the piston member 66 to move proximally in the piston cylinder 70. In order to move the piston member 66 proximally in the piston cylinder 70 in the present example, the air pressure must exert enough force to overcome the opposing force of the piston spring 71, which urges the piston member 66 distally. It will be appreciated that other configurations may be used. An advantage of the piston spring 71 is that it dictates a minimum amount of pressure that must be built up in the pressure chamber 46 before a launch will be permitted. When the pressure in the pressure chamber 46 is too low to overcome the force of the piston spring 71 exerted on the piston member 66, a launch may not be achieved; whereas a launch may be achieved when the pressure in the pressure chamber 46 is above this minimum dictated by the piston spring 71. This feature may prevent low pressure launches of the glider 10 and reduces the potential for damage to the glider 10 when the glider 10 has not obtained a high enough altitude for the wings 20 to open or sweep forward.

In the present example, the launcher 40 has a trigger mechanism 80 that controls the proximal retraction of the rod 60. As shown in FIGS. 6 through 9, the trigger mechanism 80 is comprised of a trigger button 82, a trigger stem 84, a linkage 86, a plate 88, a ball 90, and a cup 92. The linkage 86 has an opening 94 formed therethrough and a flange 96. The linkage 86 is attached to the proximal side of the proximal wall 72 of the pressure chamber 46; and the linkage 86 is configured to slide up and down along this side. The opening 94 in the linkage 86 is at least the same size as the hole 74 formed through the proximal wall 72 of the pressure chamber 46, and the linkage 86 may be slid to a position where the opening 94 in the linkage 86 is aligned with the hole 74 formed through the proximal wall 72 of the pressure chamber 46. When this hole 74 and opening 94 are so aligned, the protuberance 68 at the proximal end of the piston member 66 may fit, in part, through both holes. In the present example, this alignment will be required for the rod 60 to be sufficiently moved proximally to retract the valve 56 and thereby result in the launch of the glider 10. This proximal movement of the rod 60 will occur when (a) the force of air pressure on the piston member 66 is grater than the opposing force of the piston spring 71, (b) the opening 94 in the linkage 86 is sufficiently aligned with the hole 74 in the proximal wall 72 of the pressure chamber 46, and (c) the air pressure on the piston member 66 causes the piston member 66 to slide proximally along the rod 60, such that part of the protuberance 68 passes through the hole 74 and the opening 94, such that the protuberance 68 impinges a proximal force on the "e"-clip 69 at the proximal end 64 of the rod 60. Other variations will be apparent to those of ordinary skill in the art.

A spring 98 at the bottom of the linkage 86 urges the linkage 86 to slide upward by default, such that the linkage opening 94 and the hole 74 in the proximal wall 72 of the pressure chamber 46 are not aligned. The linkage 86 may be slid downward to align the opening 94 and hole 74 by the trigger stem 84 exerting force against the linkage flange 96. An orientation-sensitive safety feature permits this exertion of force by the trigger stem 84 only when the launch tube 50 is oriented approximately within a particular operable angular range.

As shown in FIGS. 6 through 10, the orientation-sensitive safety feature of the trigger mechanism 80 is comprised of the plate 88, the ball 90, the cup 92, and protrusions 100 on the trigger stem 84. The top surface 102 of the plate 88 has protrusions 106 that engage with the protrusions 100 on the trigger stem 84. The ball 90 rests on the inner base surface 108 of the cup 92, and is permitted to roll on the surface 108. Two springs 112 are in the wall of the cup 92, urging the plate 88 away from the inner base surface 108 of the cup 92. The springs 112 thus urge engagement of the protrusions 106 on the top surface 102 of the plate 88 with the protrusions 100 on the trigger stem 84.

Figure 9:
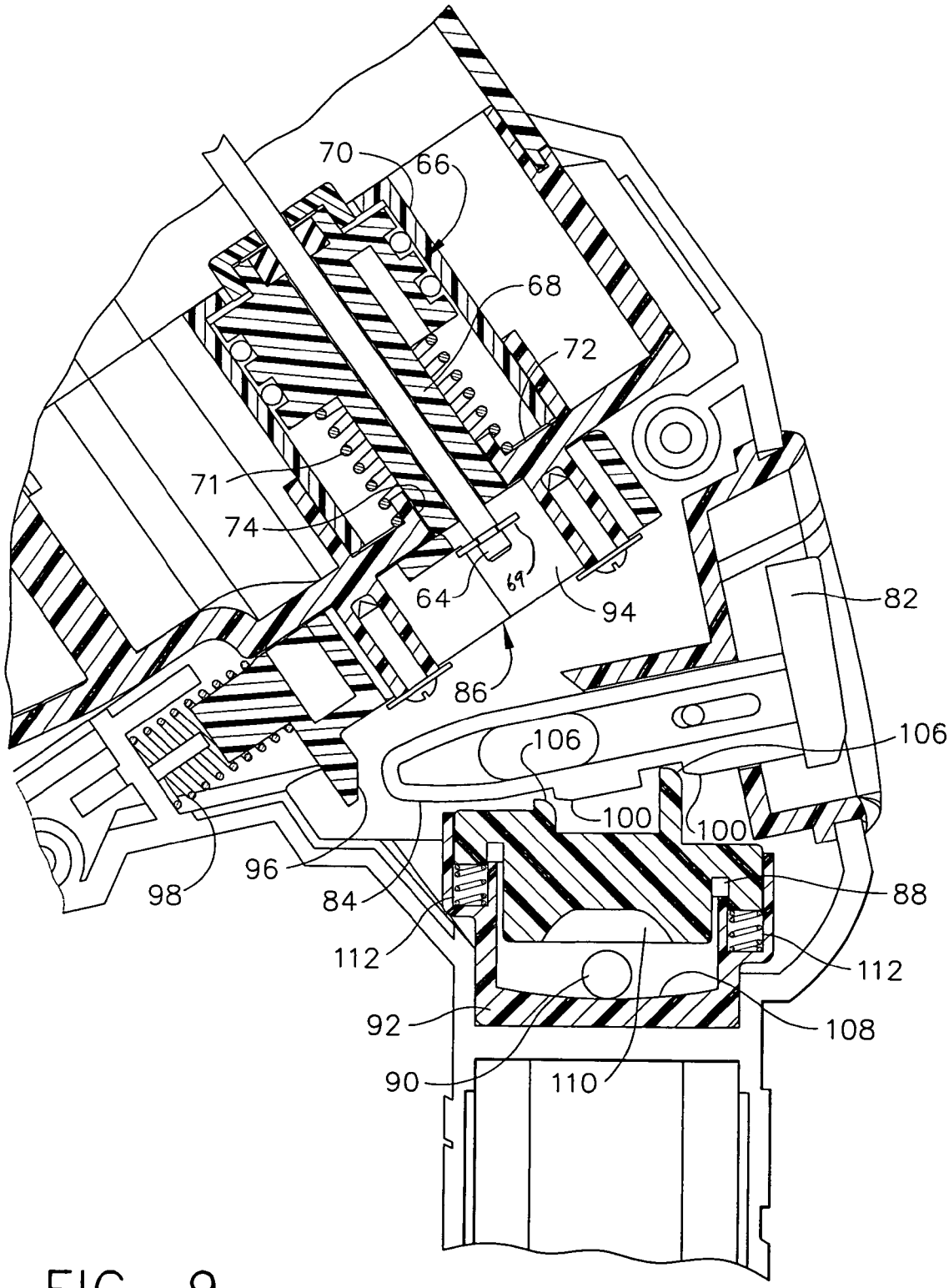
FIG. 9 depicts a trigger mechanism from the launcher of FIG. 1 in a stand-by position.
Figure 10:
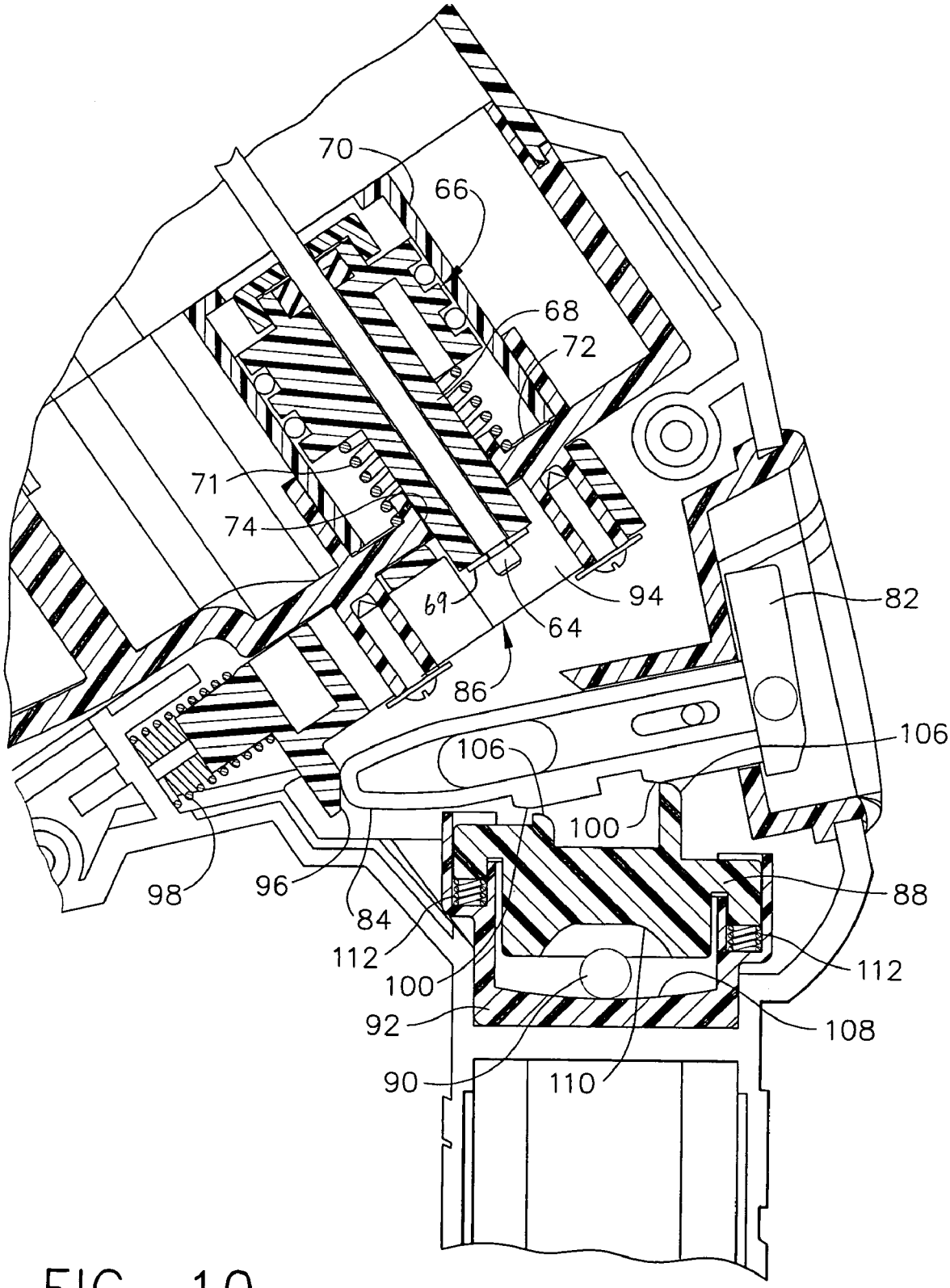
FIG. 10 depicts a trigger mechanism from the launcher of FIG. 1 in a firing position.

The inner base surface 108 of the cup 92 is curved, such that the ball 90 will be generally centered on the surface 108 when the launch tube 50 is oriented approximately within a particular operable angular range. By way of example only, the surface 108 may be generally hyperbolic, semi-circular, conical, frusto-conical, or of any suitable curvature. The bottom surface 104 of the plate 88 has a groove 110 centered therein, such that the ball 90 will be positioned underneath the groove 110 when the ball 90 is generally centered on the inner base surface 108 of the cup 92. As shown in FIGS. 9 and 10, this will occur when the launch tube 50 is oriented approximately within the operable angular range.

Figure 8:
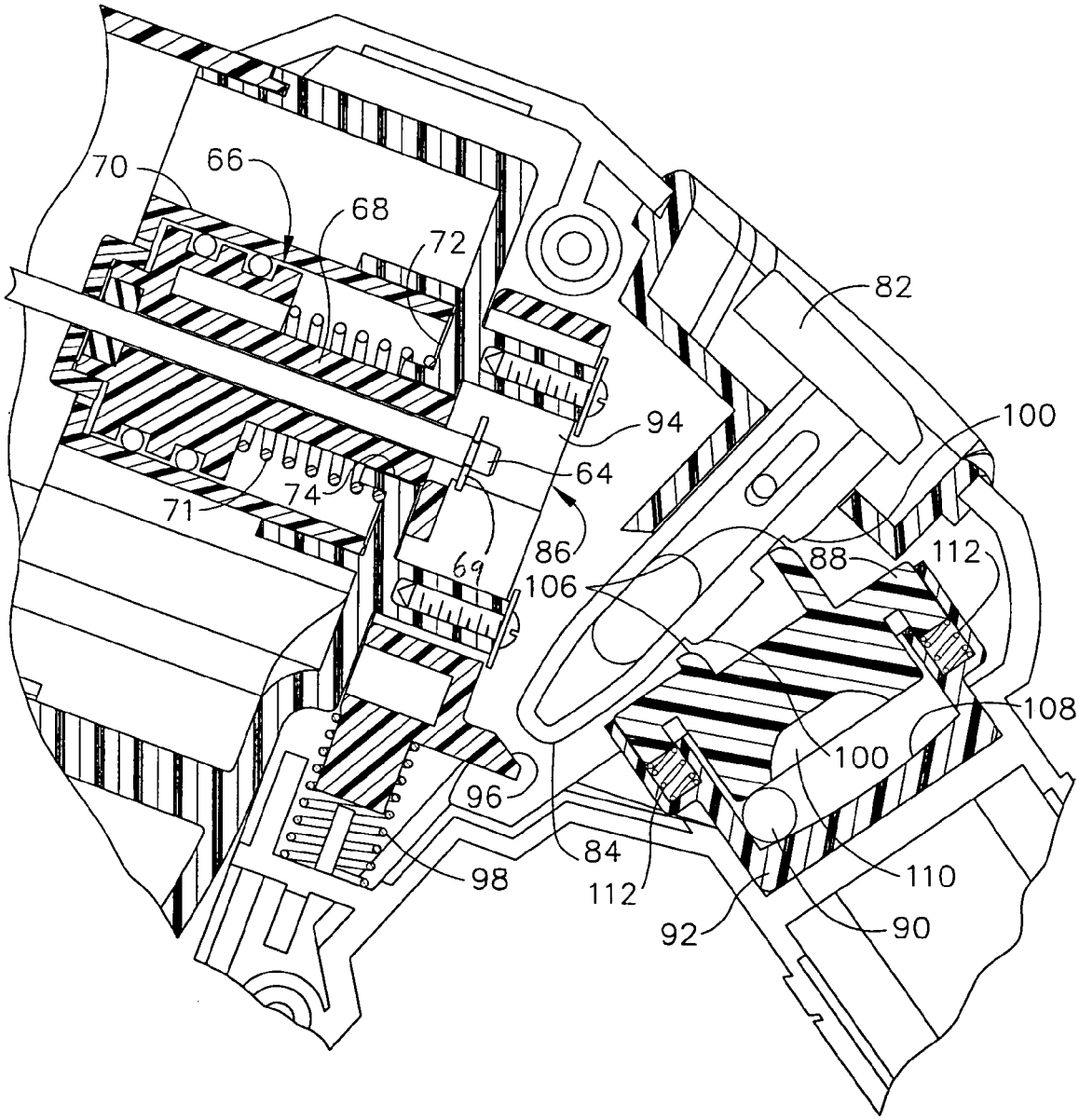
FIG. 8 depicts a trigger mechanism from the launcher of FIG. 1 in a safe position.

As shown in FIG. 8, when the launch tube 50 is not oriented approximately within the particular angular range, the ball 90 is not generally centered on the inner base surface 108 of the cup 92. Thus, the ball 90 is not positioned under the groove 110. In this positioning, the ball 90 will prevent the plate 88 from moving downward far enough to allow the protrusions 106 on the top surface 102 of the plate 88 to disengage with the protrusions 100 on the trigger stem 84. Without this disengagement, the trigger stem 84 will not be permitted to exert force on or otherwise communicate with the linkage flange 96, and hence, the glider 10 may not be launched.

As shown in FIGS. 9 and 10, when the launch tube 50 is oriented approximately within the operable angular range, the ball 90 will be generally centered on the inner base surface 108 of the cup 92 and positioned underneath the groove 110, which allows the plate 88 to move downward far enough such that the protrusions 106 on the top surface 102 of the plate 88 may disengage with the protrusions 100 on the trigger stem 84. Upon this disengagement, as shown in FIG. 10, the trigger stem 84 may exert force against the linkage flange 96. This force may be exerted by actuation of the trigger button 82, which is in mechanical communication with the trigger stem 84.

The safety feature of the trigger mechanism 80 may thus provide tactile feedback to a user indicating whether the launch tube 50 is oriented within the operable angular range. By way of example only, the trigger mechanism 80 may be configured such that the glider 10 or other projectile may be launched only when the launch tube 50 is oriented between approximately 60 and 85 degrees relative to the ground. As another example, the operable angular range may be between approximately 55 and 70 degrees, or 65 to 80 degrees. Alternatively, the trigger mechanism 60 may be configured such that the glider 10 or other projectile may be launched only when the launch tube 50 is oriented within any other angular range.

The launcher 40 may be configured such that the handle 78 is oriented generally vertically when the launch tube 50 is oriented within the operable angular range. Such a configuration may thereby provide a user visual feedback to gauge approximately whether the launch tube 50 is oriented within the operable angular range. Alternatively, the launcher 40 may be configured such that the handle 78 is oriented any other way when the launch tube 50 is oriented within the operable angular range.

While a ball 90 is used in the illustrative embodiment of an orientation-sensitive safety mechanism, it will be understood by those of ordinary skill in the art that any other means may be used to prevent launching when the launch tube 50 is not oriented within the operable angular range. Such an alternative orientation-sensitive safety mechanism may employ the use of, by way of example only, a lever or pendulum or other orientation-sensitive blocking means. It will also be appreciated that the safety feature of the present invention may be used with other trigger mechanisms.

The exterior of the launch tube 50 is generally the same shape as the interior of the glider's hollow fuselage 12 and is of a size that allows the launch tube 50 to slide into the glider's fuselage 12. The fit between the fuselage 12 and the launch tube 50 will preferably be tight enough to allow most of the air escaping the launch tube 50 through the hole 54 to propel the glider 10. While the present example discloses a cylindrical launch tube 50, it will be appreciated by those of ordinary skill in the art that any suitable shape may be used, such as, by way of example only, a triangular or square tube. Where an alternative shape is used for the launch tube 50, the inside of the glider's fuselage will preferably be of the same alternative shape, such that the fit between the fuselage and launch tube will be tight enough to allow most of the air escaping the launch tube through the hole 54 to propel the glider.

The pump 42 in the present example has a relief valve feature 120 in its proximal end. This relief valve feature 120 is comprised of a proximal hole 122 at the proximal end of the pump 42, a diaphragm 124, a spring 126, and a relief hole 128. The spring 126 urges the diaphragm 124 against the proximal hole 122. The force of the spring 126 is strong enough to allow the pump 42 to function normally, such that reciprocation of the pump 42 may pressurize air in the pressure chamber 46. However, when the air pressure is strong enough to overcome the force of the spring 126, air may escape through the proximal hole 122, past the diaphragm 124, and out the relief hole 128 to the outside of the launcher 40. Thus, the relief valve feature 120 may provide a threshold for the pressure in the pressure chamber 46 such that, when the pressure is below the threshold, the pump 42 will function normally; whereas when the pressure is above the threshold, reciprocation of the pump 42 will not cause the pressure to increase. The threshold may be dictated in part by the strength of the spring 126. Accordingly, a relief valve feature 120 may provide a means to prevent over pressurization of the pressure chamber 46.

In addition, a glider guide ramp 76 is located around the exterior base of the launch tube 50. In part, this guide ramp 76 prevents the glider 10 from rotating about the axis of the launch tube 50 when the glider 10 is fully engaged with the launch tube 50. It will be appreciated that a launcher 40 need not include this guide ramp 76, particularly when the launch tube 50 is non-cylindrical.

In the present example, the launch tube 50 acts, in part, as a support member configured to be received by the hollow fuselage 12 of the glider 10; while the fuselage 12 acts as a proximally-open receptacle configured to receive such a support member. It will be appreciated, however, that an alternative support member configuration and/or receptacle configuration may be used.

While the launcher 40 in the present example is disclosed in the context of a glider 10, it will also be appreciated by those of ordinary skill in the art that, with or without obvious alterations, the launcher 40 may be used to launch a variety of projectiles. Thus, it is not intended that the scope of the invention be limited to the launching of gliders 10. It will also be understood that a launcher 40 having an orientation-sensitive safety feature such as that in the trigger mechanism 60 of the present example may be used to launch any type of projectile. In addition, it will be appreciated that a launcher having a trigger mechanism 60 such as the one disclosed herein need not launch projectiles pneumatically. Indeed, an orientation-sensitive safety feature having aspects that are the same as or functionally equivalent to those comprising the trigger mechanism 60 of the present example may be employed in a launcher that uses, by way of example only, combustion, electromagnetic pulse, springs, or any other means to launch projectiles.

In use, the fuselage 12 of the glider 10 is slid onto the launch tube 50. The wings 20 are then rotated such that they are above or near the fuselage 12, while the annular member 28 is positioned such that the clasp 34 engages the tabs 34 of the pivot support members 24, thereby holding the wings 20 in the position above or near the fuselage 12. While a user holds the launcher 40 by the handle 78 with one hand, the pump 42 is reciprocated with the other hand, providing the desired air pressure to the pressure chamber 46. Alternatively, the pump 42 may be reciprocated to provide desired air pressure to the pressure chamber 46 prior to the glider 10 being slid onto the launch tube 50. As pressure builds in the pressure chamber 46, the piston member 66 at the proximal end 64 of the rod 60 is urged proximally by the air pressure. However, the rod 60 does not move proximally because the opening 94 in the linkage 86 is not aligned with the hole 74 formed through the proximal wall 72 of the pressure chamber 46. Thus, passage of the protuberance 68 at the proximal end of the piston member 66 is prevented by the linkage 86.

The launcher 40 is then held in a position such that the launch tube 50 is oriented within the operable angular range, allowing the ball 90 to be generally centered on the inner base surface 108 of the cup 92 and positioned underneath the groove 110. The protrusions 106 on the top surface 102 of the plate 88 may then disengage with the protrusions 100 on the trigger stem 84, allowing the trigger stem 84 to exert force on the linkage flange 98. When the trigger button 82 is actuated, the trigger stem 84 exerts force on the linkage flange 96, causing the linkage 86 to slide downward. When the linkage 86 has thus slid downward, the opening 94 in the linkage 86 becomes aligned with the hole 74 in the proximal wall 72 of the pressure chamber 46, permitting the protuberance 68 at the proximal end of the piston member 66 to fit, in part, through both openings. With this fit so permitted, the pressure built up in the pressure chamber 46 causes the piston member 66 to slide along the rod 60 proximally, such that the protuberance 58 impinges a force against the "e"-clip 69 at the proximal end 64 of the rod 60. This transfer of force causes the rod 60 to move proximally, which retracts the valve 56 at the distal end 52 of the launch tube 50, permitting the pressurized air to pass through the hole 54 at the distal end 52 of the launch tube 50. The pressurized air is thus impinged against the glider 10, thereby causing the glider 10 to be propelled into flight. When the force of the spring 58 acting against the valve 56 at the distal end 52 of the launch tube 50, and the force of the piston spring 71, overcome the pressure force urging the piston member 66 to move proximally, the rod 60 will move distally, such that the valve 56 at the distal end 52 of the launch tube 50 again covers the hole 54 at the distal end 52 of the launch tube 50. The piston spring 71 will continue to urge the piston member 66 distally, such that the part of the protuberance 68 is no longer in the opening 94 of the linkage 86. With the protuberance 68 absent from the opening 94, the linkage spring 98 urges the linkage 86 upward again, such that the opening 94 in the linkage is no longer aligned with the hole 74 in the proximal wall 72 of the pressure chamber 46.

Upon the sudden change in glider 10 velocity caused by the launch, the annular member 28 will rotate forward such that the clasp 36 is no longer engaged with the tabs 34 on the pivot support members 24. However, drag forces acting upon the glider 10 may initially hold the wings 20 in a retracted position above or near the fuselage 12. At approximately the apex of flight, the resilient tension in the rubber band 30 that is connected to the hooks 32 on the pivot support members 24 will overcome the drag and will draw the hooks 32 on the pivot support members 24 together, thereby causing the wings 20 to sweep to a fully extended position. The glider 10 will eventually glide to a safe landing.

The above components are preferably made of one or more polymeric materials. However, the components may be made of any lightweight resilient or other material. By way of example only, the nose cone 14 may be made of a soft foam material to prevent damage. Additionally, pieces of aluminum or other malleable, non-resilient material may be added on or near wing or tail stabilizer edges as a means for adjusting the wings or tail stabilizers.

It is also understood that any suitable means other than air propulsion, such as, by way of example only, liquid, solid fuel, a slingshot, combustion, or electromagnetic pulse may be used to propel the glider 10.

It will be apparent to those of ordinary skill in the art that while a preferred embodiment of the invention has been disclosed in detail, numerous other modifications and improvements may be made thereon. Some alternate embodiments of the invention are described below.

For example, in an alternate embodiment of the wing sweep mechanism, a glider consistent with aspects of the invention may use a timing mechanism to deploy the wings during flight. A timing device and a locking device for holding the wings back may comprise an alternate wing sweep mechanism that may be mounted in the forward section of the glider. The locking device may initially hold the wings proximate to the fuselage to provide a low drag configuration for the launching of the glider. An off-the-shelf timer having a winding knob may be used as the timing device to release the wings and/or cause extension of the wings subsequent to launch. The wings may be urged forward by any suitable means, such as, by way of example only, one or more resilient members or gears. The glider may be launched by any suitable launcher, such as, by way of example only, a sling shot or a pneumatic launcher.

In another embodiment of the wing sweep mechanism, a substitute for the annular member is a catch comprised of a clasp and engagement tabs. The catch is hingedly attached to the body collar. The weight distribution of the catch encourages it to rotate freely forward, relative to the fuselage, such that the clasp is drawn away from the fuselage. When the glider is slid onto the launch tube, the tabs engage an engagement ramp on the launch tube, which rotates the catch such that the clasp is drawn towards the fuselage. When the clasp is drawn toward the fuselage, the pivot support members may be rotated to a position where the wings are above the fuselage, wherein the clasp will engage the pivot support members and thereby hold the wings above or near the fuselage in a locked position. When the glider is launched, the tabs disengage the engagement ramp, which allows the catch to rotate, such that the clasp disengages with the pivot support members. With the locking mechanism in this unlocked position, the wing sweep mechanism will urge the wings to the extended position.

In yet another embodiment of the wing sweep mechanism, the rotation of the annular member to release the pivot support members may be controlled by rubber bands. A rubber band, of appropriate strength, may be selected to hold the clasp in a position nearest the fuselage such that the clasp is able to engage and hold the pivot support members. Upon launch, the rubber band will initially be able to oppose the force of gravity acting on the catch. However, the rubber band will eventually weaken and stretch allowing the annular member to rotate such that the clasp is drawn away from the fuselage, releasing the pivot support members. In this or other alternative configurations, an interface feature on the launcher, such as an engagement ramp, may not be necessary to change a locking mechanism from a locked to unlocked position. Alternatively, other interface features may be used.

A glider may alternatively incorporate an actuating mechanism that is triggered by the sudden acceleration experienced during launching, such that the actuating mechanism unlocks the wings and/or causes the extension of the wings at launch. As another example, a wing sweep mechanism may include an extension spring or a compression spring coupled between the fuselage and a wing, or between wings, to resiliently urge the wings to an extended position.

In an alternate embodiment of the trigger mechanism 60, the trigger mechanism may act as a fluid gate by controlling the transfer of air for example, between a pressure chamber and the launch tube, rendering a valve 52 at a distal end of the launch tube unnecessary. In this alternate embodiment, a spring-loaded valve prevents air from escaping the pressure chamber into the launch tube. The trigger mechanism may include a ball in a chamber above the valve and a trigger button above the chamber. The chamber may be configured such that the ball is seated directly between the trigger button and the valve only when the launcher is oriented within a particular angular range. When the launcher is so oriented, depression of the trigger button will force the ball against the valve, opening the same and allowing pressurized air in the pressure chamber to escape into the launch tube and thereby launch the glider. When the launcher is not oriented properly, and thus the ball is not seated directly between the trigger button and the valve, depression of the trigger button will not cause the opening of the valve and the glider will not be launched. As an alternative to a ball in a chamber, a pendulum, lever, or any other orientation-sensitive mechanism or configuration may be used.

In yet another alternate embodiment of the trigger mechanism, a vent hole is used to release pressurized air away from the glider when the trigger button is pressed while the launcher is not oriented within a particular angular range. This may be accomplished by providing a ball in a chamber having a vent hole, such that the ball covers the vent hole when the launcher is oriented within a particular angular range. When the trigger button is pressed while the launcher is not oriented within the particular angular range, the ball will not be covering the vent hole, and thus the pressurized air will escape through the vent hole rather than launch the glider. When the launcher is oriented within the particular angular range, the ball will cover the vent hole, allowing the pressurized air to launch the glider. As an alternative to a ball, any other device that may be used to close off fluid connection to a vent hole by way of gravitational force, such as a lever or a pendulum, may be utilized.

It will also be appreciated that the launcher 40 may further comprise a pressure chamber. In such an embodiment, the launch tube 44 may not need to be sealed, and may merely act as a member to support the glider 10 and/or act as a launch guide. It will be further appreciated that, where a pressure chamber or the like is used, the launch tube 44 may serve as a communicator of the pressurized fluid. In addition, while the present example discloses a manual air pump 42 as a pneumatic pressure source, any alternative pneumatic pressure source may be used, such as, by way of example only, an automatic air compressor or other suitable source.

In summary, numerous benefits have been described which result from employing the concepts of the invention. While the present invention has been illustrated by the description of several embodiments and while the illustrative embodiments have been described in considerable detail, it is not the intention of the applicant to restrict or in any way limit the scope of the appended claims to such detail. The foregoing description of one or more embodiments of the invention has been presented for purposes of illustration and description. It is not intended to be exhaustive or to limit the invention to the precise form disclosed. Obvious modifications or variations are possible in light of the above teachings without departing from the invention. It should be understood that every structure described above has a function and such structure can be referred to as a means for performing that function. The one or more embodiments were chosen and described in order to best illustrate the principles of the invention and its practical application to thereby enable one of ordinary skill in the art to best utilize the invention in various embodiments and with various modifications as are suited to the particular use contemplated. Accordingly, it is intended that the invention be limited only by the spirit and scope of the appended claims.

We claim:

1. A toy glider system comprising:

(a) a glider, comprising:

pivoting wings, and a proximally-open receptacle; and (b) a launcher operable to launch said glider, comprising:

a support member configured to be received by said receptacle, a trigger, an opening, a pneumatic pressure source, and a launch feature configured to selectively communicate a pressurized medium from said pressure source to impinge said pressurized medium against said glider, wherein the launch feature comprises a valve member, wherein the valve member is configured to selectively block and unblock the opening in the launcher in response to user input via the trigger.

2. The toy glider system of claim 1, wherein said glider further comprises a fuselage, said fuselage comprising said receptacle.

3. The toy glider system of claim 1, wherein said receptacle is cylindrical, wherein said support member is comprised of a tube configured to slidably engage with said receptacle.

4. The toy glider system of claim 1, wherein said support member includes at least a portion of said launch feature at a distal end of said support member.

5. The toy glider system of claim 4, wherein said opening is positioned at the distal end of said support member.

6. The toy glider system of claim 1, wherein said pneumatic pressure source comprises a manual pump.

7. The toy glider system of claim 6, wherein said manual pump includes a relief valve feature, wherein said relief valve feature is responsive to the amount of pressure created by the pump, wherein said relief valve feature provides a maximum amount of pressure that may be created by the pump while substantially maintaining pressure created by the pump.

8. The toy glider system of claim 5, said glider further comprising (a) a fuselage having a front end and a rear end;

(b) a nose attached to said front end of said fuselage;

(c) one or more tail stabilizers attached to said rear end of said fuselage; and (d) a wing sweep mechanism comprising:

an annular member having a clasp, a collar member, wherein said annular member is hingedly attached to said collar member, one or more pivot support members comprising a first end and a second end and hooks near said first end, wherein said support members are hingedly attached at said first end of said support members to said collar member, wherein said wings are attached to said support members, and an elastic member, wherein said elastic member is connected to said hooks, wherein said clasp is configured to engage each said first end of said support members.

9. The toy glider system of claim 8, wherein said annular member is configured to disengage said clasp with each said first end of said support members upon launch of said glider.

10. A toy glider system comprising:

(a) a glider, comprising pivoting wings, and a wing sweep mechanism comprising a locking mechanism, wherein said locking mechanism is operable to hold said wings in a retracted position when said locking mechanism is in a locked position, wherein said wing sweep mechanism is operable to urge said wings to an extended position when said locking mechanism is in an unlocked position; and (b) a launcher operable to launch said glider;

wherein said locking mechanism is configured to change from said locked position to said unlocked position when said glider is launched from said launcher.

11. A toy glider system, comprising:

(a) a glider, said glider comprising wings, and a means to pivot said wings; and (b) a launcher, said launcher comprising a means to launch said glider, and a means to limit an angular range within which said glider may be launched from said launcher, the angular range comprising a range of angles defined by the glider relative to the ground.

12. The toy glider system of claim 1, wherein the valve member is urged proximally in response to pressure provided by the pneumatic pressure source, wherein the valve member is configured to unblock the opening of the launcher upon proximal movement of the valve member.

13. The toy glider system of claim 12, wherein the trigger is operable to selectively permit proximal movement of the valve member.

14. The toy glider system of claim 5, wherein the valve member is configured to selectively cover and uncover the hole at the distal end of the support member.

15. The toy glider system of claim 7, wherein the relief valve feature comprises a resilient member in communication with a diaphragm, wherein the resilient member and diaphragm are configured to resist certain amounts of pressure created by the manual pump, wherein the certain amounts of pressure are less than the maximum amount of pressure.

16. The toy glider system of claim 15, wherein the maximum amount of pressure that may be created by the pump is a function of the resilience of the resilient member.

17. The toy glider system of claim 7, wherein the relief valve feature is configured to release pressure in excess of the maximum amount of pressure that may be created by the pump without causing launch of the glider.

18. The toy glider system of claim 10, wherein said locking mechanism is configured to change from said locked position to said unlocked position in response to a sudden change in velocity of the glider.

19. The toy glider system of claim 18, wherein the sudden change in velocity is independent of the orientation of the glider relative to the ground.

20. A toy glider system comprising:

(a) a glider, comprising:

pivoting wings, and a wing sweep mechanism comprising a locking mechanism, wherein said wing sweep mechanism is configured to exert one or more deployment forces urging said wings to an extended position, wherein said locking mechanism is operable to hold said wings in a retracted position when said locking mechanism is in a locked position, wherein said locking mechanism is configured to permit the one or more deployment forces to urge said wings to an extended position when said locking mechanism is in an unlocked position; and (b) a launcher operable to launch said glider;

wherein said locking mechanism is configured to change from said locked position to said unlocked position substantially contemporaneously with an act of launching the glider from the launcher, wherein the glider is configured such that drag forces acting upon the wings during an initial stage of trajectory of the glider overcome the one or more deployment forces to maintain the wings in one or more retracted positions until the one or more deployment forces overcome the drag forces.

* * * * *